United States Patent [19]

Abadie et al.

[11] 4,320,703

[45] Mar. 23, 1982

[54] TARGET DETECTING DEVICE

[75] Inventors: Erwin I. Abadie; Kenneth A. Lawlor; John O. Dick, all of Riverside, Calif.

[73] Assignee: United States of America as represented by the Secretary of the Navy, Washington, D.C.

[21] Appl. No.: 553,344

[22] Filed: May 27, 1966

[51] Int. Cl.[3] ..... F42C 13/04

[52] U.S. Cl. ..... 102/214

[58] Field of Search ..... 102/18, 19.2, 70.2, 102/416–420, 427, 211–214; 343/7 PF

[56] References Cited

U.S. PATENT DOCUMENTS

| | | | |
|---|---|---|---|
| 3,162,119 | 12/1964 | Tate, Jr. et al. | 102/18 |
| 3,326,130 | 6/1967 | Baker | 102/70.2 |
| 3,332,077 | 7/1967 | Nard et al. | 102/70.2 |

*Primary Examiner*—Charles T. Jordan

*Attorney, Agent, or Firm*—Robert F. Beers; J. M. St. Amand; T. M. Phillips

[57] ABSTRACT

A passive target detecting system for discriminating against off-target radars. A signal from the missile guidance representing the pulse repetition frequency of the target being tracked is combined in a coincidence circuit with the signals received by the target detecting device.

1 Claim, 4 Drawing Figures

TARGET DETECTING DEVICE

The invention herein described may be manufactured and used by or for the Government of the United States for governmental purposes without the payment of any royalties thereon or therefor.

In prior known target detecting devices there exists a serious limitation in that an early firing can occur in a multiple-target environment. This multiple-target limitation exists especially with passive type seekers where the target is a radar and as the missile approaches a target, other radars located near the target radar, as for example, land-based early warning systems or a ground control intercept target complex, may be sensed by the target detecting device which, as a result, fires early.

The present invention provides a passive target detecting system which has the capability of discriminating against off-target radars. Discrimination against off-target radars is achieved by combining a signal from the missile guidance representing the pulse repetition frequency of the target being tracked, with the signals received by the target detecting device, in the coincidence circuit to permit firing only on the desired target.

Accordingly, an object of the present invention is to provide a passive type target detecting device which will discriminate against off-target radars.

Another object is to provide a passive type target detecting device which will discriminate against off-target radars by combining pulse repetition frequency information from the missile guidance with target information from the target detecting device.

Figure 1:
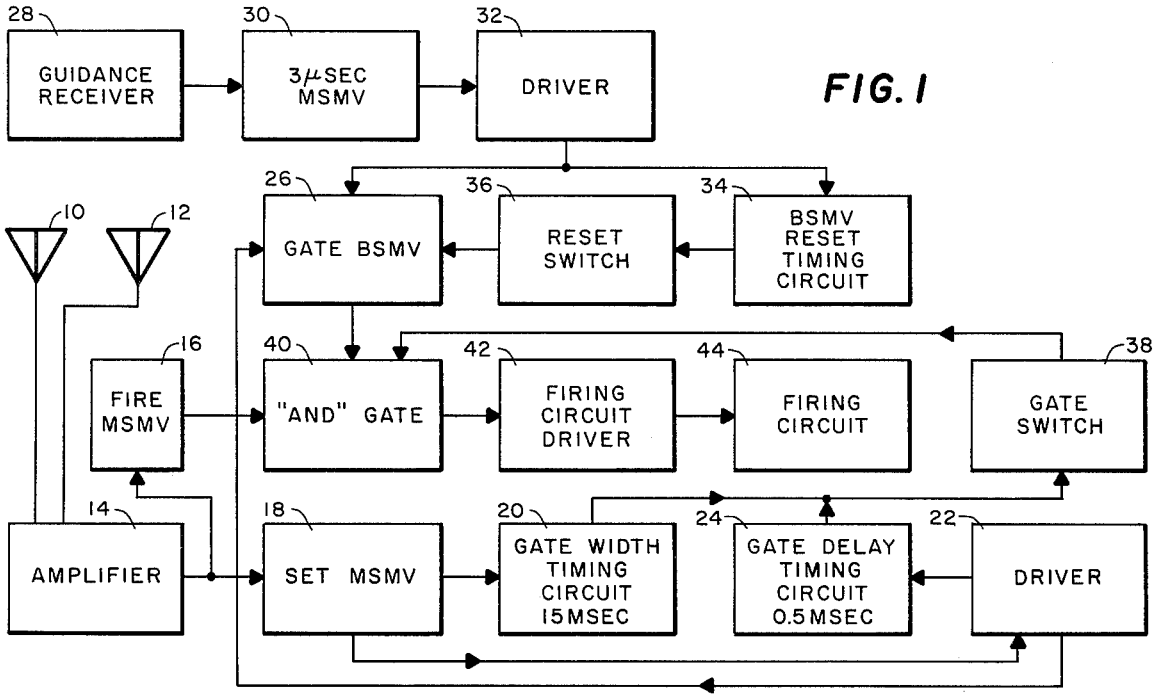

Other objects and many of the attendant advantages of this invention will become readily appreciated as the same becomes better understood by reference to the following detailed description when considered in connection with the accompanying drawings wherein:

FIG. 1 is a block diagram of a preferred embodiment of the invention.

FIGS. *2a* and *2b* are a schematic diagram of the embodiment of FIG. 1.

Figure 3:
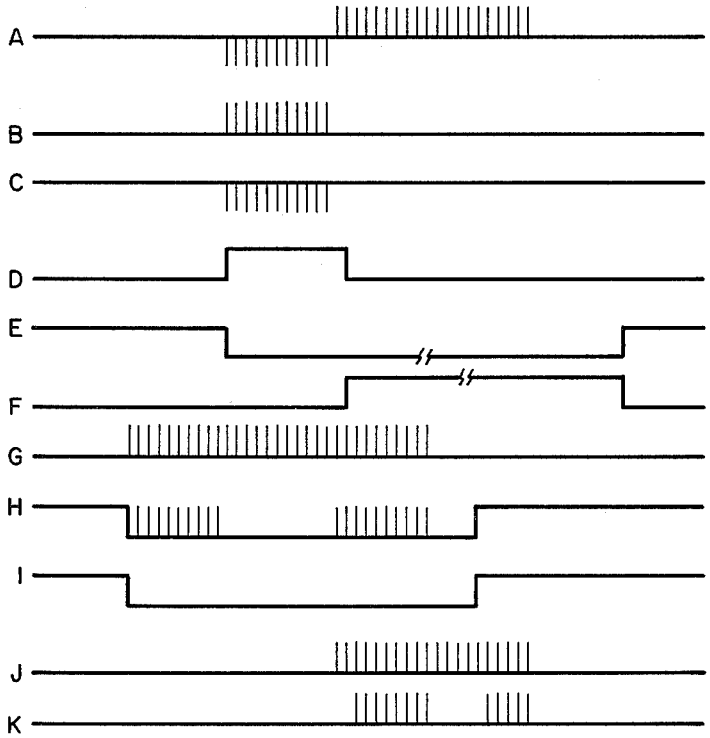

FIG. 3 shows examples of waveforms at selected points of the diagram of FIG. 1.

Referring to FIG. 1 there is shown antenna 10, 12 for receiving signals from radiating targets which by way of example may be early-warning radars. The signals received at antennas 10, 12 are fed to amplifier 14 where the signals are amplified and fed to fire monostable multivibrator 16 and set monostable multivibrator 18 which produces a first output that is fed to gate width timing circuit 20 and a second output that is fed to driver circuit 22. Driver circuit 22 provides a first output which is fed to gate delay timing circuit 24 and a second output that is fed to gate bistable multivibrator 26. A signal proportional to the pulse repetition frequency of the target is fed from guidance receiver 28 to a three microsecond monostable multivibrator 30. The output from monostable multivibrator 30 is coupled through driver circuit 32 to gate bistable multivibrator 26 and bistable multivibrator reset timing circuit 34. The timing pulse from circuit 34 is fed to reset switch 36 which provides a fail-safe signal to gate 26.

The outputs from gate width timing circuit 20 and gate delay timing circuit 24 are fed to gate switch 38 which provides one of the control signals for "and" gate 40. The other control signals for "and" gate 40 are supplied by fire monostable multivibrator 16 and gate bistable multivibrator 26. The output of "and" gate 40 is fed through a driver circuit 42 to provide a firing pulse for firing circuit 44.

Figure 2A:
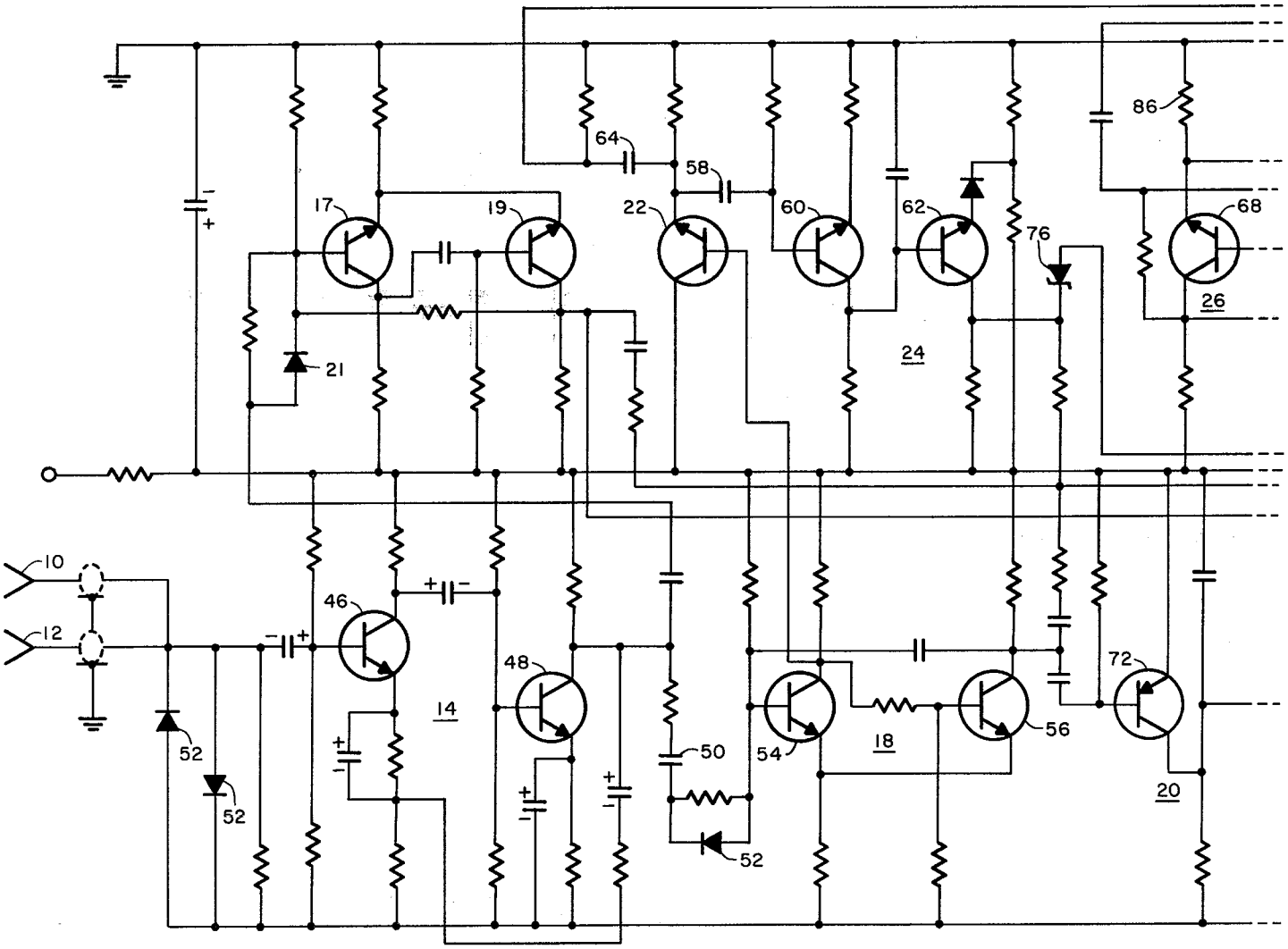
Figure 2B:
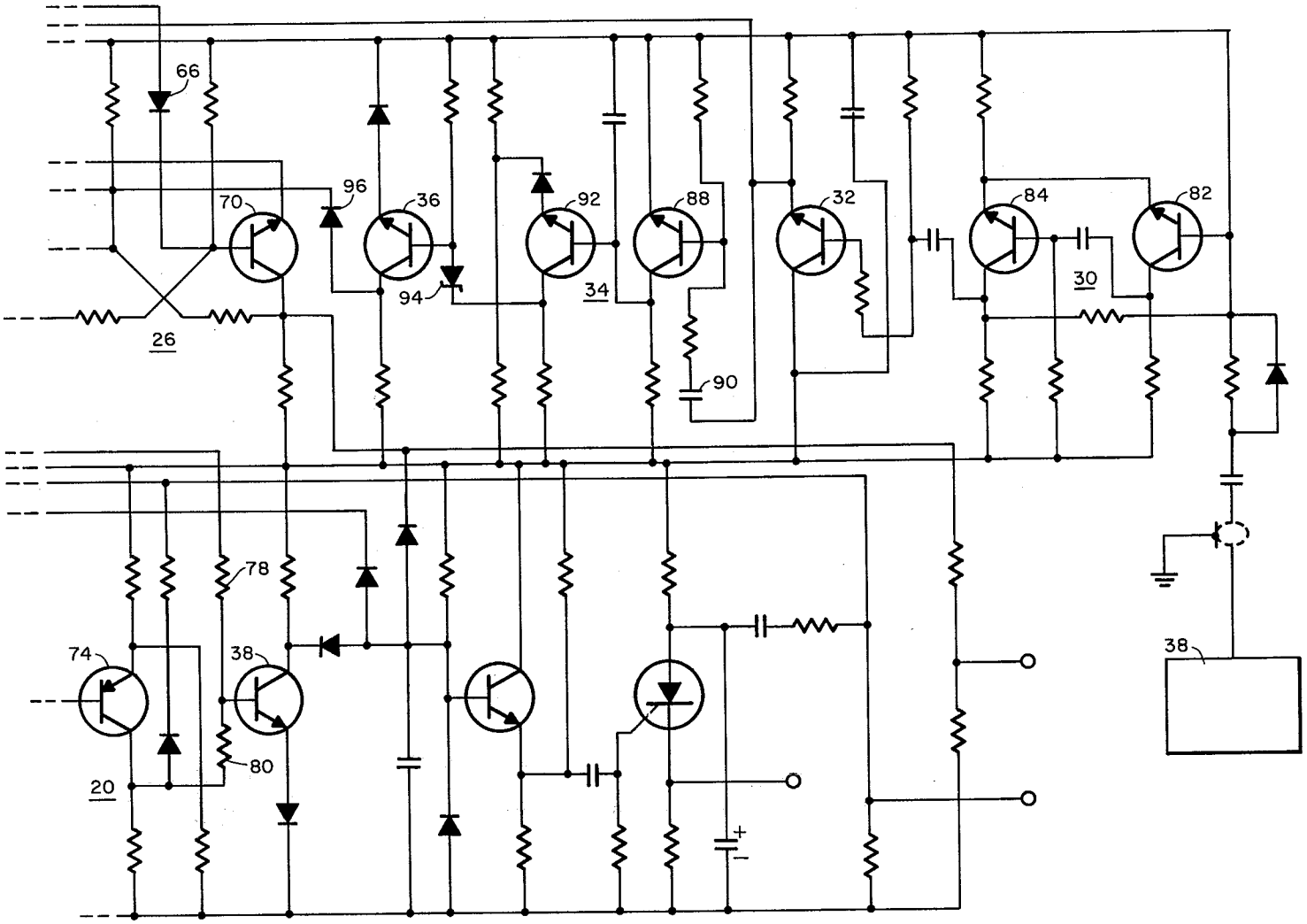

Referring to the schematic diagram of FIG. 2, the signals from antennas 10, 12 are added and fed to amplifier 14 which is preferably a wideband Class A amplifier and consists of transistors 46 and 48. Diodes 50 and 52 are included to limit the amplitude of the input signal. The output pulses from amplifier 14 are coupled through coupling capacitor 50 and steering diode 52 to the input stage of monostable multivibrator 18 which consists of transistors 54 and 56. The output of amplifier 14 is also fed to monostable multivibrator 16 which consists of transistors 17 and 19. Steering diode 21 couples only the positive pulses received after the critical antenna function angle is reached. The output pulses from multivibrator should be of constant amplitude and width. The output of transistor 54, which is initially conducting feeds positive pulses to the inputs of gate delay timing circuit 24 and gate bistable multivibrator 26 through driver transistor 22. The output of driver 22 is coupled through coupling capacitor 58 to the input of delay timing circuit 24 which consists of transistors 60 and 62. The output of driver 22 is also coupled through coupling capacitor 64 and diode 66 as one of the inputs to gate bistable multivibrator 26 which consists of transistors 68 and 70. The output of transistor 72 which is initially cut off, feeds negative pulses to the input of gate width timing circuit 20 which consists of transistors 72 and 74.

When transistor 62 is conducting, an output from gate delay timing circuit 24 is coupled to the base of gate switch 38 through Zener diode 76 and resistor 78. The output of gate width timing circuit 20 is coupled from the output of transistor 74 through resistor 80 to the base of gate switch 38.

Signals from guidance receiver 38 are fed to monostable multivibrator 30 which consists of transistors 82 and 84. The output from multivibrator 30 is taken from transistor 84 and fed as an input to gate bistable multivibrator 26 through driver 32 and coupling capacitor 86 and to the base of transistor 88 of reset timing circuit 34 through driver 32 and coupling capacitor 90. Reset timing circuit consists of transistors 88 and 92 which provides an output that is fed to reset switch 36 through Zener diode 94. When switch 36 is conducting, a signal is fed as an input to gate circuit 26 through diode 96.

In operation, signals from antennas 10 and 12 are received whenever the electromagnetic energy is at a minimum peak amplitude of 4 watts/meter$^2$. The antenna signal received before the function angle is achieved is a series of negative pulses (waveform A). These negative pulses are fed through amplifier 14 to monostable multivibrator 18. Monostable multivibrator 18 controls gate width timing circuit 30 and gate delay timing circuit 24 which feed into gate 38 which controls one of the inputs to "and" gate 40 preceding firing circuit 44. Initially, the sum of the potentials of the output of timing circuits 20 and 24 is such that there is no signal at the output of switch 38. When a negative signal is received from antennas 10 and 12 and monostable multivibrator 18 is triggered, the two timing circuits are switched to the opposite state. Gate width timing circuit 20 will flip over and remain in this condition as long as there are pulses out of set monostable multivibrator 18. Gate delay timing circuit 24 will flip back to its original condition 500 μsec after each pulse. Each time gate delay circuit 24 is allowed to return to its original condition, the output of switch 38 is at a high potential, thereby applying a signal to one input of "and" gate 40. Gate width timing circuit 20 will return to its original condition, 15 ms after the last pulse is received from set monostable multivibrator 18, thus removing the signal from "and" gate input 40.

The guidance receiver sensing signal provided by guidance receiver 28 to the target detecting device is a 200 nanosec pulse of 6 volts amplitude minimum which is fed to 3 μsec monostable multivibrator 30. Monostable multivibrator 30 feeds positive pulses 3 μsec in width and 6 volts in amplitude to the gate bistable multivibrator 26. Initially, the output stage of bistable multivibrator 26 is in the conduction mode. The leading edge of the guidance signal (waveform G) turns the output stage of bistable multivibrator off and the trailing edge restores it to the conduction mode. The output stage of bistable multivibrator 26 is fed to the input of "and" gate 40. Each time bistable multivibrator 26 is turned off a signal (waveform H) is applied to "and" gate 40. The output of set monostable multivibrator 18 (waveforms B and C) is also fed to bistable multivibrator 26. When the negative pulses from set monostable multivibrator 18 (waveform C) are coincident with the signal from the guidance receiver (waveform G), gate bistable multivibrator 26 remains in conducting. Therefore, no signal is applied to the "and" gate 40.

The output from 3 μsec monostable multivibrator 30 is also fed to bistable multivibrator reset timing circuit 34. Timing circuit 34 is used as a fail-safe circuit to turn off bistable multivibrator 26 in the absence of a signal from guidance receiver 28. When a signal from guidance receiver 28 is present, the state of reset timing circuit 34 is such that no signal is applied to bistable multivibrator 26. Timing circuit 34 changes states 5 ms after the last pulse is received from guidance receiver 28, and a signal is applied to bistable multivibrator 26 keeping its output stage cutoff.

The signal output from amplifier 14 changes from negative pulses to positive pulses as the critical angle of the signals received at antennas 10 and 12 is reached (waveform A). These positive pulses are fed to monostable multivibrator 16, the output of which is fed as the third input to the "and" gate 40. Should signals be applied to all three inputs of "and" gate 40, an output signal is generated which is fed through driver circuit 42 to firing circuit 44. All three signals (waveforms F, H, and J) must be coincident in order to produce an output (waveform K) that will trigger firing circuit 44 (waveform L).

Obviously many modifications and variations of the present invention are possible in the light of the above teachings. It is therefore to be understood that within the scope of the appended claims the invention may be practiced otherwise than as specifically described.

We claim:

1. In a target detecting device of the passive type for use in a guided missile the combination comprising:

(a) signal receiving means for receiving signals from radiating targets for producing negative and positive output pulses, (b) missile guidance circuit means for receiving signals from radiating targets and producing output signals representing the pulse repetition rate of the target radar of interest.

(c) an "and" gate circuit having a plurality of inputs and an output, (d) first gate signal generating means coupled to said signal receiving means and to one of the inputs of said "and" gate for generating a first gate signal in response to received negative pulses, (e) second gate signal generating means coupled to said signal receiving means and to one of the inputs of said "and" gate for generating a second gate signal in response to received positive pulses, (f) third gate signal generating means coupled to said missile guidance circuit and to one of the inputs of said "and" gate for generating a gate signal in response to the guidance signal representing the pulse repetition rate of the target radar of interest, (g) firing circuit means coupled to the output of said "and" gate and being responsive to an output signal from said "and" gate when all three gate signals are simultaneously present to initiate a firing signal.

2. The target detecting device of claim 1 wherein said first gate signal generating means comprises:

(a) a monostable multivibrator having an input coupled to said signal receiving means and being responsive to the negative pulses for producing negative and positive output pulses of constant amplitude and width, (b) a gate delay timing circuit coupled to said monostable multivibrator and being responsive to the positive pulses from said monostable multivibrator for producing output pulses after a predetermined delay, (c) a gate width timing circuit coupled to said monostable multivibrator and being responsive to the negative pulses from said monostable multivibrator for producing an output pulse having a width proportional to the presence of the negative input pulses, (d) a gate switch having an input coupled to said gate delay timing circuit and to said gate width circuit and being responsive to the sum of the output signals from said gate delay timing circuit and said gate width timing circuit to produce an output signal when said sum is of a predetermined value.

3. The target detecting device of claim 1 wherein said second gate signal generating means comprises a monostable multivibrator and being responsive to positive pulses from said signal receiving means for producing an output pulse indicating that the target is in range for firing of the warhead.

4. The target detecting device of claim 1 wherein said third gate signal generating means comprises a bistable multivibrator having an input coupled to the guidance circuit of the missile for producing an output gate pulse when the pulse repetition rate as determined by the guidance system of the missile is the same as the pulse repetition rate as determined by the target detecting device.

5. The target detecting device of claim 2 wherein said second gate signal generating means comprises a monostable multivibrator and being responsive to positive pulses from said signal receiving means for producing an output pulse indicating that the target is in range for firing of the warhead.

6. The target detecting device of claim 3 wherein said third gate signal generating means comprises a bistable multivibrator having an input coupled to the guidance circuit of the missile for producing an output gate pulse when the pulse repetition rate as determined by the guidance system of the missile is the same as the pulse repetition rate as determined by the target detecting device.

* * * * *